US010045648B1

(12) United States Patent
Epstein et al.

(10) Patent No.: US 10,045,648 B1
(45) Date of Patent: Aug. 14, 2018

(54) DOOR AND WINDOW INTERIOR MAILBOX

(71) Applicants: Moshe Epstein, Northbrook, IL (US); Lihy Epstein, Northbrook, IL (US)

(72) Inventors: Moshe Epstein, Northbrook, IL (US); Lihy Epstein, Northbrook, IL (US)

( * ) Notice: Subject to any disclaimer, the term of this patent is extended or adjusted under 35 U.S.C. 154(b) by 0 days.

(21) Appl. No.: 15/640,526

(22) Filed: Jul. 1, 2017

(51) Int. Cl.
*A47G 29/122* (2006.01)

(52) U.S. Cl.
CPC ..... *A47G 29/1223* (2013.01)

(58) Field of Classification Search
CPC ..... A47G 29/1223; A47G 29/12
USPC ..... 232/19, 45; 220/476
See application file for complete search history.

(56) References Cited

U.S. PATENT DOCUMENTS 782,229 A * 2/1905 Field ..... A47G 29/1223 232/19
2,229,646 A * 1/1941 Firestone ..... A47G 29/1223 220/6
3,802,620 A * 4/1974 Ferrara ..... A47G 29/12 232/19
4,069,965 A * 1/1978 Maddox, Jr. ..... A47G 29/1223 232/19
4,826,075 A * 5/1989 Burns ..... A47G 29/1223 211/88.01
5,368,226 A * 11/1994 Franceschino ..... A47G 29/1223 232/19
5,897,053 A * 4/1999 Cirimele ..... A47G 29/12 232/17
6,959,858 B2 * 11/2005 Stagnaro ..... A47G 29/12 232/19
7,182,243 B2 * 2/2007 Plappert ..... A47G 29/12 232/19
7,240,823 B1 * 7/2007 Saidiazar ..... A47G 29/12 232/19
2002/0070269 A1 * 6/2002 Rosiello ..... A47G 29/12 232/19
2006/0065705 A1 * 3/2006 Plappert ..... A47G 29/12 232/19

* cited by examiner

*Primary Examiner* — William L Miller
(74) *Attorney, Agent, or Firm* — Steven Ivy P.C.

(57) ABSTRACT

An interior mailbox, hard-mounted to the exterior door or window, designed to capture and to hold the mail dropped by the mail carrier from the outside in, through the cutout in said exterior door or window, comprising of two primary components, the container and the adjustment part, made to adjust the width of the bottom of the mailbox to accommodate the varying mounting surfaces and to prevent the mail from falling out of the mailbox.

3 Claims, 6 Drawing Sheets

DOOR AND WINDOW INTERIOR MAILBOX

FIELD OF THE INVENTION

The present invention relates to mailboxes and other devices for receiving and holding mail.

BACKGROUND OF THE INVENTION

Over the years, a wide variety of mail collecting devices, or mailboxes, have been invented and many of them found their way to the open market. Perhaps the most popular mail collecting device, currently utilized by the U.S. residential mail recipients, is the tunnel-shaped mailbox. Which according to the historians did not become mandatory in the U.S. until early 1920s.

However, majority of U.S. businesses utilize commercial-style mailboxes, which could be divided into three categories: 1) multiple door mailbox units, similar to a traditional postal boxes located within a post office, which are typically mounted indoors or positioned outside on a pedestal; 2) wall mounted mailboxes, servicing primarily individual businesses; 3) and mail slot units, also known as mail chutes, which are most commonly mounted to the front door of a business, and in some instances to a garage door.

The present invention focuses on the latter one of the commercial-styled mailboxes, the mail slot units. The mail slot units are typically mounted to the entry or garage door of a business, and in some instances to an easily accessible wall. As the name impels, the installation of said mailbox requires creation of a narrow slot, or a cut-out, through which the mail can be pushed though. Unfortunately, most of the commercially available slot type mailboxes, provide only decorative cut-out enclosures, with rudimentary systems for opening and closing the access to the mail slot. Very few of these systems incorporate means for stopping the delivered mail from hitting the floor and scattering around the room.

The present invention addresses the above-listed shortcomings by providing a new device for both collecting and holding the delivered mail. Specifically, the present invention is an adjustable indoor mailbox, mountable to a wall, window or a door, designed to capture the delivered mail and to make the retrieval of the mail easily accessible to the recipient of the delivered mail.

The present invention comprises of two primary components, the container and the adjustment part. Wherein the adjustment part's primary function is to close any gaps through which the mail may fall through, and the container part's primary function is to store the delivered mail. Said primary components could be manufactured from a wide variety of materials, including but not limited to wood, plastic, and/or steel.

Examples of prior-art, addressing various incarnations of mailboxes designed to capture the mail delivered through a cut-out in a door, may be found in the following U.S. Pat. Nos. 432,254; 449,593; 473,138; 476,139; 756,559; 782,229; 1,640,153; 1,797,961; 2,128,689; 2,229,646; 2,829,820; 3,802,620; 4,069,965; 4,776,512; 4,826,075; 5,029,753; 5,368,226; 5,492,272; 5,897,053; 6,945,451; 6,959,858; 7,182,243; 7,240,823; Ser. No. 11,805,393; 20090184159; 20020070269; 2011005242.

In fact, the U.S. Patent Applications No. 20020070269 (by Richard and Karen Rosiello); No. 20090184159 and No. 2011005242 (both by Camie A. Crawford); and the following U.S. Pat. No. 449,593 (granted to William Scott); No. 782,229 (granted to Marcellus S. Field); U.S. Pat. No. 1,640,153 (granted to Ole O. Kolstad); U.S. Pat. No. 1,797,961 (granted to George McBride); U.S. Pat. No. 2,128,689 (granted to Joseph Bingham Francis); U.S. Pat. No. 2,829,820 (granted to Algert F. Evers); U.S. Pat. No. 3,802,620 (granted to Ferrara); U.S. Pat. No. 4,069,965 (granted to Herman H. Maddox, Jr.); U.S. Pat. No. 4,776,512 (granted to Lee P. Moore, Sr., Mary A. Moore); U.S. Pat. No. 5,368,226 (granted to Luisa M. Franceschino); U.S. Pat. No. 5,492,272 (granted to Brian R. Fewer); U.S. Pat. No. 7,182,243 (granted to Thomas W. Plappert), and the U.S. Pat. No. 7,240,823 (granted to Jafar Saidiazar), all implement in their designs a mail catching receptacle made out of a flexible material—which is the key differentiating feature between the present invention and the above-listed prior art.

More specifically, the mail catching receptacles of said prior art incorporate in their designs plastic bags and pouches made of cloth. However, the mail catching receptacle of the present invention is made of a structurally firm material, such as stainless steel, forming a rectangular shape, designed to adjust its width to accommodate uneven mounting surfaces.

U.S. Pat. No. 432,254 (granted to William Taylor), discloses a device using a hinged mechanism for opening the mailbox attached to the door, without any visible means of collecting the delivered mail and/or preventing it from falling out. This patent differs significantly from the present invention as its design does not incorporate an interior mailbox assembly, comprising of the container and adjustment part, mountable to a wall, window or a door; made to adjust its width to accommodate uneven mounting surface, to capture and hold the delivered mail, preventing it from falling on to the floor.

U.S. Pat. No. 473,138 (granted to Peter Anderson), and the U.S. Pat. No. 476,139 (granted to Jack A. Favv), both disclose a mail receptacle, designed to swivel in and out of the door's large opening, allowing for collection of the mail in an elongated container. These patents differ significantly from the present invention, as they do not incorporate an interior mailbox assembly, comprising of the container and adjustment part, mountable to a wall, window or a door; made to adjust its width to accommodate uneven mounting surface and to capture the delivered mail.

U.S. Pat. No. 1,756,559 (granted to Edward J Knapp), the U.S. Pat. No. 1,805,393 (granted to Lizzie Fanchier Zada), and the U.S. Pat. No. 4,826,075 (granted to Donald S. Burns), disclose a door mailbox, incorporating an interior mail collector, in a shape of a box or a basket, for collection of the delivered mail. Unlike the present invention's mailbox assembly, the interior box of the prior art does not provide for adjustment of its width, making it impossible to function with uneven surfaces, such as a glass door with a much thicker door frame, which might be utilized for mounting of the mailbox assembly.

U.S. Pat. No. 2,229,646 (granted to Michael Firestone), discloses a receptacle, incorporating an elaborate hinging mechanism, designed to automatically expand as its contents increase in volume. This patent differs significantly from the present invention as its design does not incorporate an interior mailbox assembly, comprising of the container and adjustment part, mountable to a wall, window or a door; made to adjust its width to accommodate uneven mounting surface, to capture and hold the delivered mail, preventing it from falling on to the floor.

U.S. Pat. No. 5,029,753 (granted to Francisco Hipon, Lau S. Wing), and the U.S. Pat. No. 5,897,053 (granted to Ronald Cirimele), disclose a mailbox designed to catch the mail delivered through a mail slot, incorporated in a garage door.

This patent differs significantly from the present invention as its design is specifically designed to function with garage doors, and does not incorporate an interior mailbox assembly, comprising of the container and adjustment part, mountable to a wall, window or a front door; made to adjust its width to accommodate uneven mounting surface, and to capture and hold the delivered mail.

U.S. Pat. No. 6,945,451 (granted to Earl Bridges), discloses a mail receptacle, comprising of two separate components, the first mounted to the exterior and to second mounted to an interior of a door, incorporating locking mechanism and two swiveling flaps, designed to restrict accessibility to the delivered mail. These patents differ significantly from the present invention, as they do not incorporate an interior mailbox assembly, comprising of the container and adjustment part, mountable to a wall, window or a door; made to adjust its width to accommodate uneven mounting surface and to capture the delivered mail.

U.S. Pat. No. 6,959,858 (granted to Brent Joseph Stagnaro), discloses a mail receptacle device, designed to attach beneath a mail slot created in a door, and to utilize the contact, the delivered mail makes with the face-plate of said device, to trigger, the accordion-like, automatically enlarging mail container. These patents differ significantly from the present invention, as they do not incorporate an interior mailbox assembly, comprising of the container and adjustment part, mountable to a wall, window or a door; made to adjust its width to accommodate uneven mounting surface and to capture the delivered mail.

SUMMARY OF THE INVENTION

The following is intended to be a brief summary of the invention and is not intended to limit the scope of the invention:

The present invention discloses an interior mailbox, hard-mounted to the exterior door or window, designed to capture and to hold the mail dropped by the mail carrier from the outside in, through the mail slot of said exterior door or window. The invention comprises of two primary components, the container (forming an open-faced receptacle) and the adjustment part (forming an L-shaped component). The L-shaped component is mounted inside of the open-face of the container part, using a plurality of standardized assembly fasteners. The primary function of the container part, is to provide the mounting surface for attaching the mailbox, and to capture and hold the deposited mail. The primary function of the adjustment part is to accommodate for varying mounting surfaces. More specifically, to provide the means of adjusting the width of the bottom of the container part, filling the gaps between the container part and the glass of the door/window to which the mailbox has been attached, and by doing so, prevent the delivered mail from falling out. Both components, the container and the adjusting part, could be made from a wide variety of materials, including but not limited to plastic, wood and steel.

BRIEF DESCRIPTION OF THE DRAWINGS

The components shown in the drawings are not to scale. In the interest of clarity, some of the components might be shown in a generalized form and could be identified utilizing commercial designations. All components, including its essential features, have been assigned reference numbers that are utilized consistently throughout the descriptive process outlined herein.

DESCRIPTIVE KEY

100—Door and Window Interior Mailbox Assembly
- 120—Container Part; Forming an Open-Faced Receptacle
  - 121—Mounting Wall
  - 122—Mounting Wall Clearance Holes
  - 123—First Side Wall
  - 124—Back Wall
  - 125—Back Wall Viewing Ports
  - 126—Second Side Wall
  - 127—Second Side Wall Clearance Holes
  - 128—Bottom Wall
  - 129—Bottom Wall Clearance Holes
- 140—Adjustment Part; Forming an L-Shaped Component
  - 141—First Side Wall
  - 142—First Side Wall Slotted Clearance Holes
  - 143—Second Side Wall
  - 144—Bottom Wall
  - 145—Bottom Wall Slotted Clearance Holes
- 160—Assembly Fasteners
  - 161—Bolt
  - 162—Nut
  - 163—Washer

200—Business Building
210—Door
220—Window
230—Mail Drop-In Cutout
500—Mail
600—Individual Depositing and/or Retrieving the Mail

DETAILED DESCRIPTION OF THE PREFERRED EMBODIMENT

Figure 1:
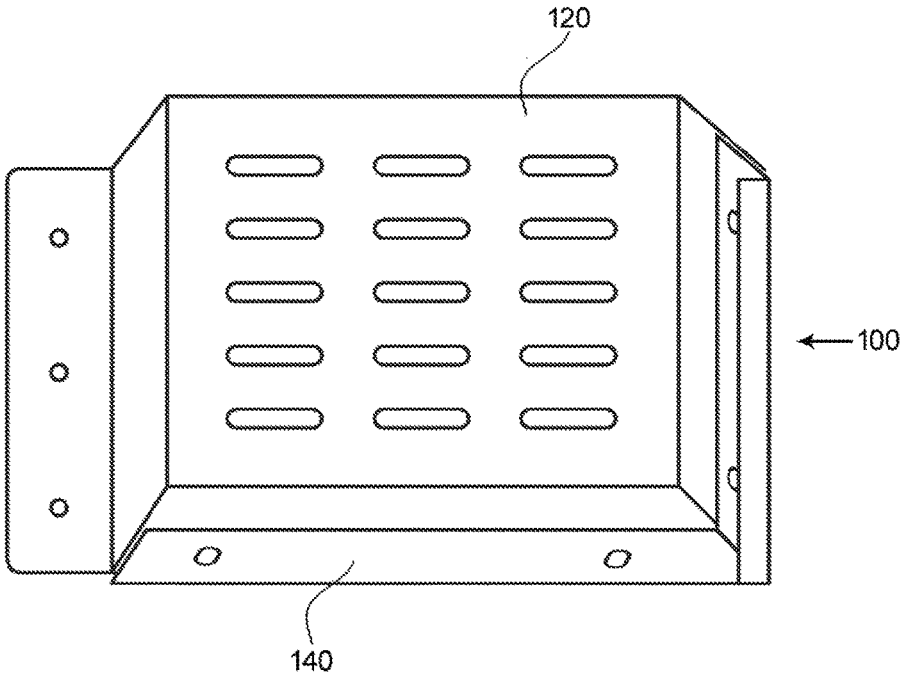
FIG. 1 is a perspective view of two primary components, the container and adjustment part, connected together to form a complete assembly, in accordance with an exemplary embodiment of the present invention.

The following description references to the above-defined drawings and represents only an exemplary embodiment of the invention. It is foreseeable, and recognizable by those skilled in the art, that various modifications and/or substitutions to the invention could be implemented without departing from the scope and the character of the invention:

FIG. 1 shows a perspective view of the present invention, the door and window interior mailbox assembly 100. As show in FIG. 2, the mailbox assembly 100 comprises of two main components, a container part 120, forming an open-faced receptacle, and an adjustment part 140, forming an L-shaped component.

Figure 2:
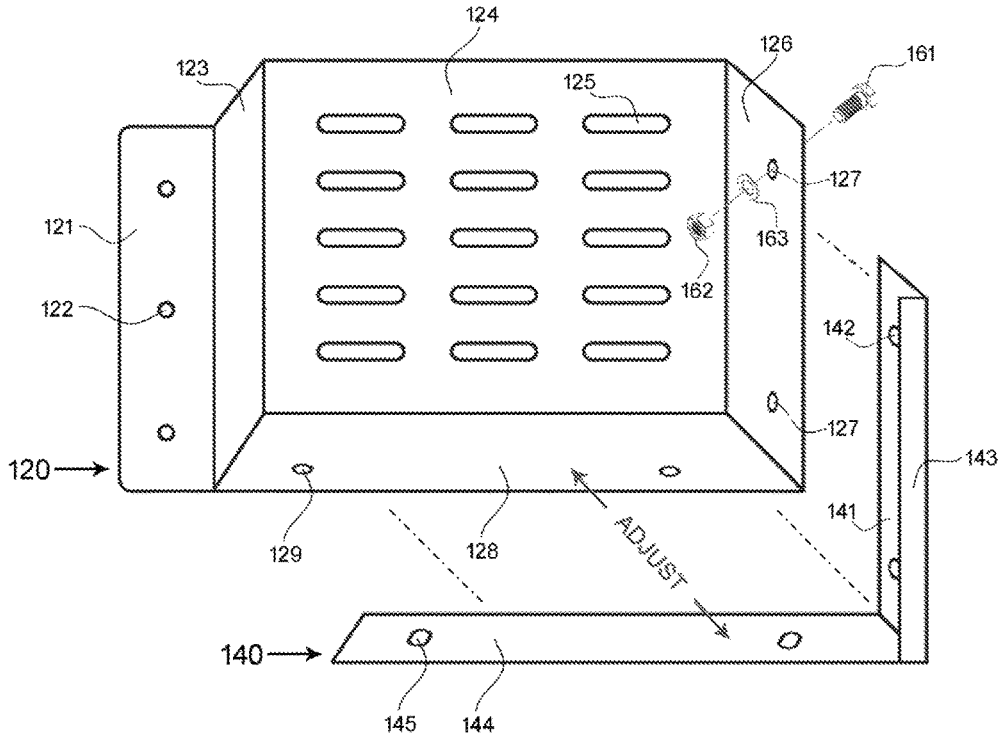
FIG. 2 is a perspective view of the door and window interior mailbox, showing its two primary parts separated from each other, and the fastener assembly, used for holding the primary part together, in disassembled condition, in accordance with an exemplary embodiment of the present invention.

The primary function of the container part 120, shown in FIG. 2, is to provide the mounting surface for attaching the mailbox 100 to the interior side of a door 210 or window 220 of a building 200, and to capture and to hold the deposited mail 500. The container part 120 could be made from a wide variety of materials, including but not limited to plastic, wood and steel. The container part 120 comprises of a mounting wall 121 with three clearance holes 122, first side wall 123, back wall 124 with a plurality of viewing ports 125, second side wall 126 with two clearance holes 127, and a bottom wall 128 with two clearance holes 129.

Figure 3:
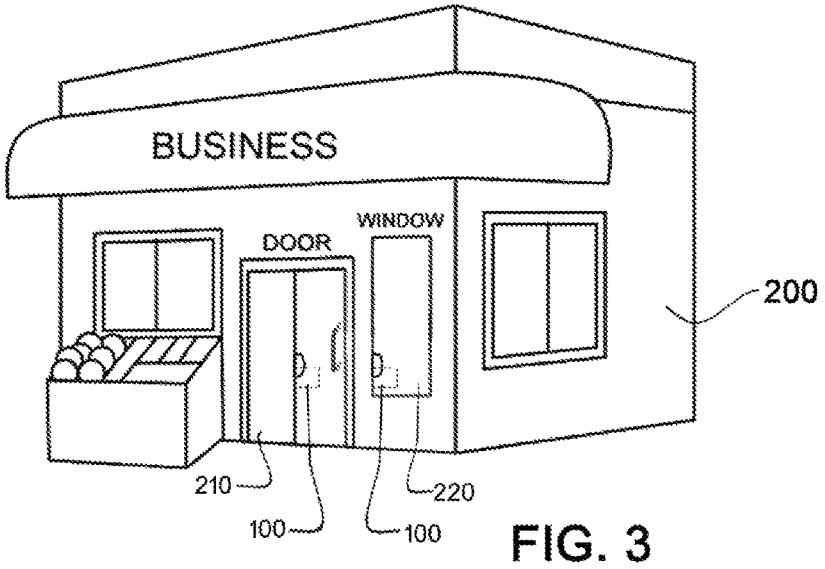
FIG. 3 is an exterior view of a business building, showing the door and window interior mailbox, attached to the entry door and the display window of said business building, in accordance with an exemplary embodiment of the present invention.

As shown in FIG. 3, the adjustment part 140 is an L-shaped component, which similarly to the container part 120, may be manufactured from a wide variety of materials, including but not limited to plastic, wood and steel. The primary function of the adjustment part 140 is to accommodate for varying mounting surfaces. More specifically, to provide the means of adjusting the width of the bottom of the container part 120, and thus to fill the gaps between the container part 120 and the glass of the door/window to which the mailbox 100 has been attached, to prevent the delivered mail from falling out. The adjustment part 140 comprises of a first side wall 141 with two slotted clearance holes 142, second side wall, and a bottom wall 144, housing two slotted clearance holes 145.

To utilize the mailbox 100, the end-user must slide the L-shaped adjustment part 140 into the open-face of the container part 120, as shown in FIG. 2. When doing so, the end-user must line up the container's 120 clearance holes, 127 and 129, with the adjustment part's 140 slotted clearance holes, 142 and 145. The two components, 120 and 140, are then secured together, utilizing commonly available assembly fasteners 160, including bolts 161, nuts 162 and washers 163, as shown in FIG. 2.

Figure 4:
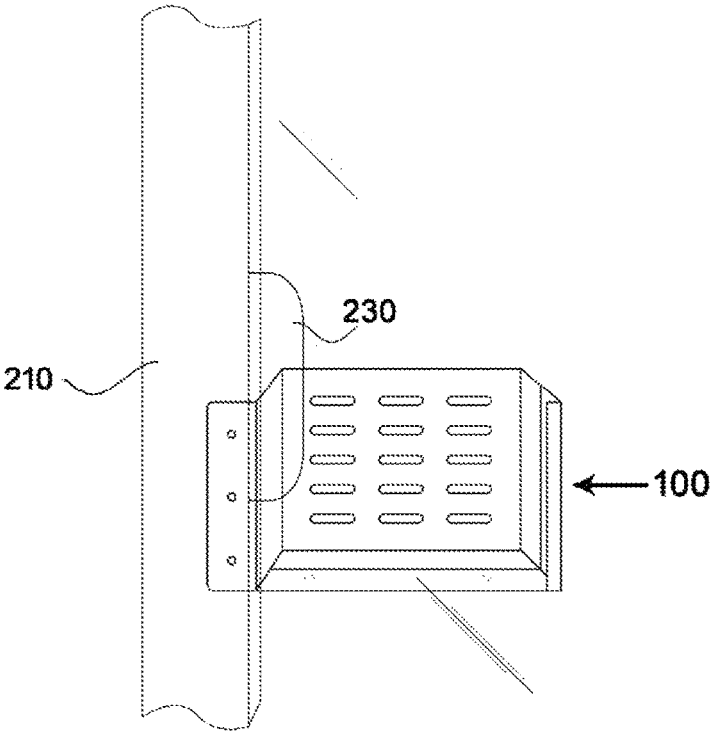
FIG. 4 is a perspective view of the door and window interior mailbox assembly, attached to a door frame, as seen from outside looking in through the glass, positioned strategically to catch the mail dropped through the mail drop-in cutout, made on the glass of said door, in accordance with an exemplary embodiment of the present invention.
Figure 6:
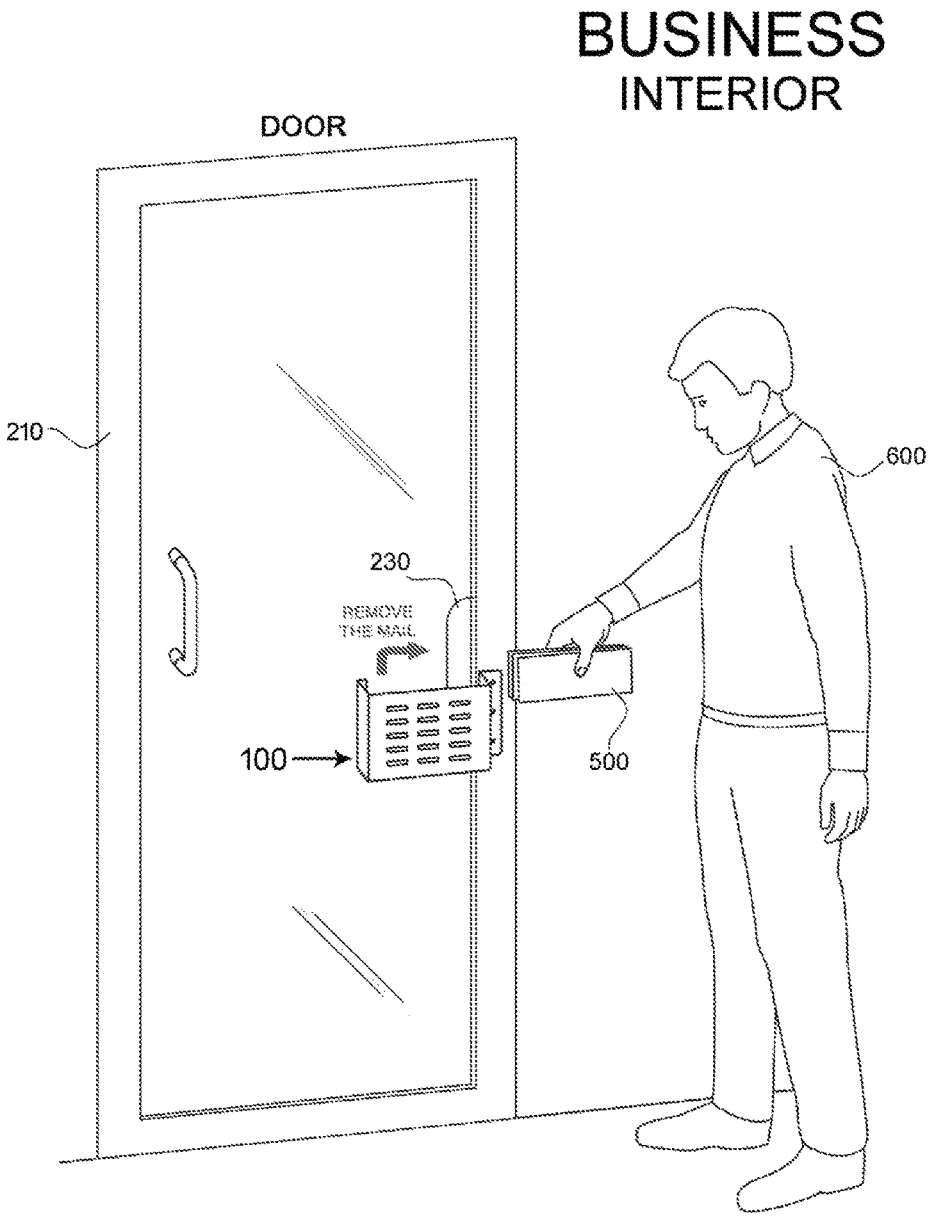
FIG. 6 is an interior view of a business building, showing the door and window interior mailbox attached to the door frame, and an individual retrieving the mail from said mailbox, in accordance with an exemplary embodiment of the present invention.
Figure 7:
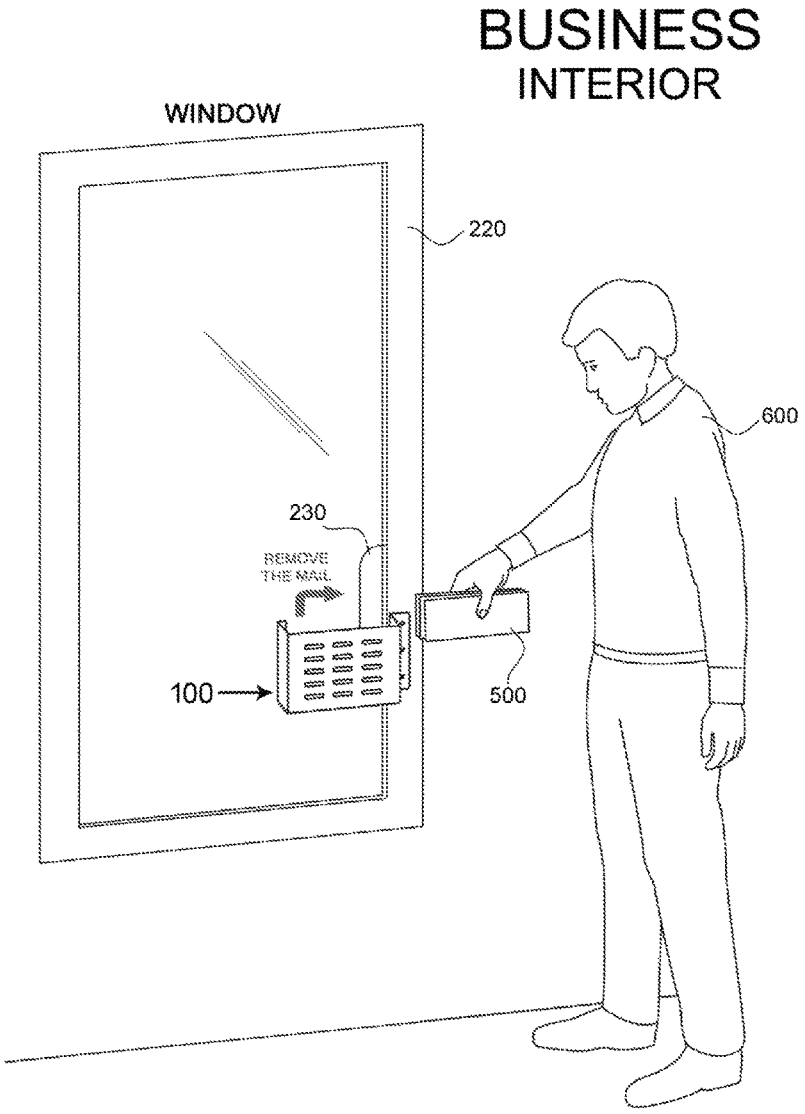
FIG. 7 is an interior view of a business building, showing the door and window interior mailbox attached to the window frame, and an individual retrieving the mail from said mailbox, in accordance with an exemplary embodiment of the present invention.

As shown in FIGS. 3, 6 and 7, the mailbox assembly 100 should be mounted inside of a building 200. The mailbox 100 may be attached to the interior side of the exterior door 210 or the window 220, as shown in FIGS. 4, 6 and 7.

Figure 5:
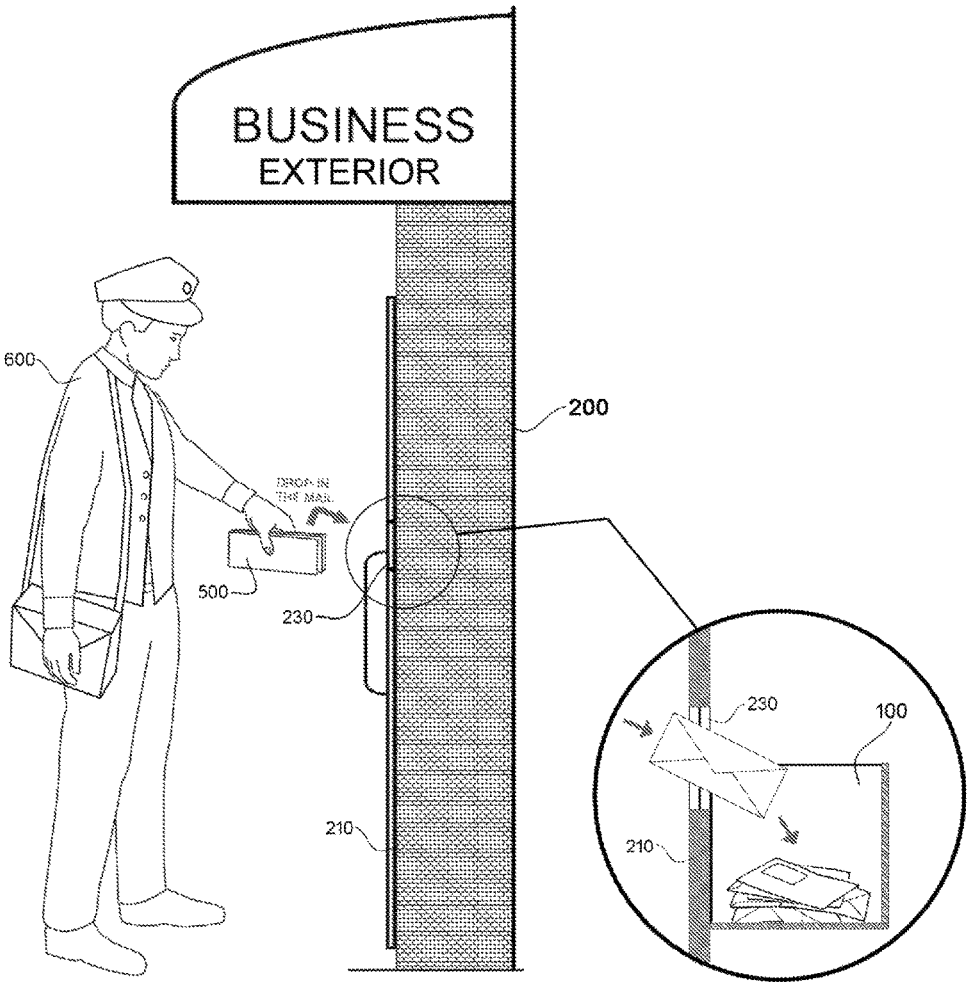
FIG. 5 is a side profile, showing exterior of a business building with its door closed, showing an individual depositing mail through the mail drop-in cutout of said doors, in accordance with an exemplary embodiment of the present invention.

To begin the process of attaching the mailbox assembly 100, the end-user must create a mail drop-in cutout 230, either in the door 210 or the window 220, which will be used to slide through the delivered mail 500, into the container part 120, as shown in FIG. 5. Said mail drop-in cutout 230 could be made in the glass or any other material from which the exterior doors are made.

Once the mail drop-in cutout 230 has been completed, the end-user may begin the process of mounting the mailbox 100. To do so, the end-user will drive commercially available bolts 161 through the clearance holes 122 of the mounting wall 121 into the desired mounting surface. Said mounting surface may include the wall or the exterior door, as shown in FIGS. 4, 6 and 7, as long as the positioning of the mailbox 100, allows for the mail 500 being delivered by the mail carrier 600, to drop thought the drop-in cutout 230 directly into the container part 120.

Once the mailbox assembly 100 is firmly mounted, the end-user may loosen the assembly fasteners 160, connecting the container part 124 with the adjustment part 140, and push the adjustment part 140 toward the surface containing the mail drop-in cutout 230. This adjustment should eliminate any gaps and prevent the mail 500 from falling out of the mailbox assembly 100.

What is claimed is:

1. A mailbox for use with mail drop-in cutouts incorporated into doors and windows, comprising:

a container part, forming a receptacle having an open face, designed to mount on an inside of a door or a window incorporating a mail drop-in cutout, placed in a position to capture mail objects delivered through the mail drop-in cutout; and an adjustment part forming an L-shaped component containing a plurality of slotted clearance holes, wherein said L-shaped component is made to slide inside the open face of the container part, designed to adjust laterally by using said plurality of slotted clearance holes, to eliminate a gap where the mail objects can fall through, located between the container part and the door or the window incorporating the mail drop-in cutout.

2. The mailbox of claim 1 wherein:

said container part further comprises of a mounting wall containing a plurality of mounting wall clearance holes used for mounting the container part to the window or the door incorporating the mail drop-in cutout, a first side wall, a back wall containing a plurality of back wall viewing ports used for viewing the accumulating mail objects, a second side wall containing a plurality of second side wall clearance holes, a bottom wall containing a plurality of bottom wall clearance holes; and said L-shaped component comprises a vertical first side wall containing a plurality of first side wall slotted clearance holes, a vertical second side wall, perpendicular to the first side wall and designed to make contact with the door or the window housing the mail drop-in cutout, and a horizontal bottom wall containing a plurality of bottom wall slotted clearance holes.

3. The mailbox of claim 2 further comprising:

a plurality of assembly fasteners comprising a plurality of bolts, nuts and washers, wherein the adjustment part is attached to the container part using the plurality of assembly fasteners, mounted through the clearance holes located in the bottom and the second side wall of the container part and the corresponding slotted clearance holes located in the bottom wall and the first side wall of the L-shaped component.

* * * * *